US005239225A

United States Patent [19]

Moriya et al.

[11] Patent Number: 5,239,225

[45] Date of Patent: Aug. 24, 1993

[54] SPARK PLUG FOR USE IN INTERNAL COMBUSTION ENGINE

[75] Inventors: Toru Moriya; Tunekazu Enomoto; Mitsutaka Yoshida, all of Nagoya, Japan

[73] Assignee: NGK Spark Plug Co., Ltd., Nagoya, Japan

[21] Appl. No.: 750,291

[22] Filed: Aug. 27, 1991

[30] Foreign Application Priority Data

Sep. 29, 1990 [JP] Japan ..... 2-258878

[51] Int. Cl.[5] ..... H01T 13/20

[52] U.S. Cl. ..... 313/141; 313/142; 313/143

[58] Field of Search ..... 313/141, 143, 142

[56] References Cited

U.S. PATENT DOCUMENTS 2,353,620 7/1944 Weinerth ..... 313/143 X
4,122,366 10/1978 Stutterheim et al. ..... 313/142 X
4,845,400 7/1989 Takamura et al. ..... 313/142
5,124,612 6/1992 Takamura et al. ..... 313/143 X

*Primary Examiner*—Palmer C. Demeo
*Attorney, Agent, or Firm*—Cooper & Dunham

[57] ABSTRACT

A spark plug for an internal combustion engine includes a metallic shell within which a tubular insulator is placed, a center electrode is provided within the insulator to form a spark gap between a front end of the center electrode and an outer electrode extending from the metallic shell. First and second stepped portions are provided near a front portion of the center electrode to form a clearance between an outer wall of the center electrode and an inner wall of the insulator. The stepped portions have a progressively decreasing diameter toward the front end of the center electrode. A tapered portion is provided at an inner wall of the insulator by bevelling a front open end of the insulator. This maintains high insulation of the insulator with significantly low carbon deposit, thus avoiding ignition failure of the spark plug.

1 Claim, 3 Drawing Sheets

SPARK PLUG FOR USE IN INTERNAL COMBUSTION ENGINE

BACKGROUND OF THE INVENTION

1. Field of the Invention

This invention relates to a spark plug for use for internal combustion engine, and particularly concerns to a spark plug so improved to enable to remove wet and dry carbon deposit by self-cleaning action with a relatively simple structure.

2. Description of Prior Art

In a spark plug for use in internal combustion engine, there is provided a tubular insulator within a metallic shell. Within the insulator, a center electrode is provided so that the center electrode is thermally sealed by a sealant, and supported by a shoulder portion which is provided at an inner wall of the insulator. Then the center electrode is brought its outer surface into tight engagement with an inner surface of the insulator so as to be integrally supported by the insulator. This is to protect the center electrode against an impact which is caused from combustion of air-fuel mixture in a combustion chamber since a front portion of the center electrode is exposed to the combustion chamber.

With the operating passage of the spark plug, a very slight clearance unavoidably occurs between an outer surface of the center electrode and an inner surface of the insulator. The slight clearance catches the air-fuel mixture by capillary action to retain it as droplets of liquid fuel. The droplets of the liquid fuel, thus retained, continuously remain without being replaced by swirl which accompanies the combustion. The liquid fuel absorbs particulate carbon to reduce insulation resistance between the insulator and the center electrode so as to cause misfire.

On the other hand, a deposit of dry carbon placed between the outer surface of the center electrode and the inner surface of the insulator, works to reduce an insulation resistance between the insulator and the center electrode so as to occasion misfire.

Therefore, it is an object of the invention to provide a spark plug which is capable of removing the particulate carbon and the dry carbon deposit to prevent the insulation resistance from unfavorably decreasing, and of contributing to an extended period of service life with a relatively simple structure.

SUMMARY OF THE INVENTION

According to the invention, in a spark plug which includes a metallic shell within which a tubular insulator is placed, and having a center electrode provided within the insulator to form a spark gap between a front end of the center electrode and an outer electrode extended from the metallic shell: a plurality of stepped portions provided with a front portion of the center electrode to form a clearance between an outer wall of the center electrode and an inner wall of the insulator, the stepped portions being arranged to progressively decrease their diameter toward the front end of the center electrode; and a tapered portion provided at an inner wall of the insulator by bevelling a front open end of the insulator.

More particularly there is provided a first stepped portion and a second stepped portion of progressively decreasing diameter toward the front end of the center electrode, the dimensional relationship among L1, L2, L3, L4, L5 and L6 being as follows:

$$L1 \geqq 0.1 \text{ mm}, \ 1.0 \text{ mm} \geqq L2 \geqq 0.3 \text{ mm},$$

$$L3 \geqq 0.2 \text{ mm}, \ L4 \geqq 0.3 \text{ mm},$$

$$L5 \geqq 0.1 \text{ mm}, \ L6 \geqq 0.1 \text{ mm},$$

where L1=a distance between an outermost periphery of the tapered portion and an outer surface of the second stepped portion;

L2=a length of the first stepped portion;

L3=a lateral difference between the outermost periphery and an innermost periphery of the tapered portion;

L4=a longitudinal distance between an outer surface of the first stepped portion and the innermost periphery of the tapered portion;

L5=a radius difference between the first stepped portion and the second stepped portion; and L6=a radius difference between the first stepped portion and the center electrode.

The plurality of stepped portions and the tapered portion work to take in flares of combustion swirl to remove droplets of liquid fuel retained between the center electrode and the insulator, and thus prevent particulate carbon from being caught between the center electrode and the insulator so as to sufficiently resist a decrease of an insulation resistance.

The stepped portions work to make use of spark between the center electrode and the outer electrode so as to facilitate self-cleaning action, and remove a dry carbon deposit between the center electrode and the insulator.

These and other objects and advantages of the invention will be apparent upon reference to the following specification, attendant claims and drawings.

DETAILED DESCRIPTION OF THE EMBODIMENTS

Figure 1:
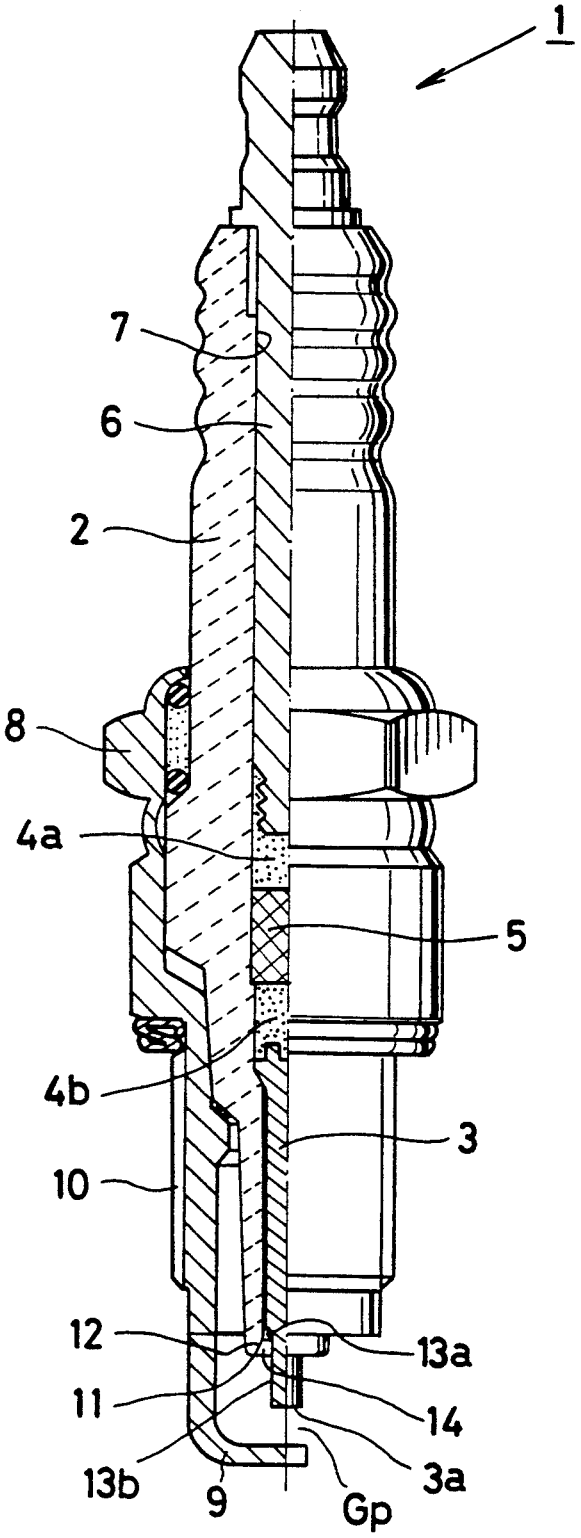
FIG. 1 is a plan view of a spark plug according to an embodiment of the invention, but a left half of the spark plug is sectioned.

Referring to FIG. 1 which shows a spark plug 1 for use in an internal combustion engine. The spark plug 1 has a cylindrical metallic shell 8 which has a male thread 10 to mount the spark plug 1 on a cylinder head (not shown) of the internal combustion engine. Within the metallic shell 8, a tubular insulator 2 is concentrically placed with its inner space as an axial bore 7. Within the insulator 2, a terminal electrode 6 and a center electrode 3 are respectively placed in concentric and thermally sealing relationship with the insulator 2. The terminal electrode 6 is rigidly connected in series with the center electrode 3 through an electrically conductive sealant 4*a*, a resistor 5 and an electrically conductive sealant 4*b*. An front portion of the center electrode 3 is exposed from an front end of the insulator 2 to form a firing tip 3*a* at a front end of the center electrode 3. The firing tip 3*a* somewhat extends beyond a front end of the insulator 2 to from a spark gap (Gp) between the firing tip 3*a* and an outer electrode 9 extended downward from the metallic shell 8.

Figure 2:
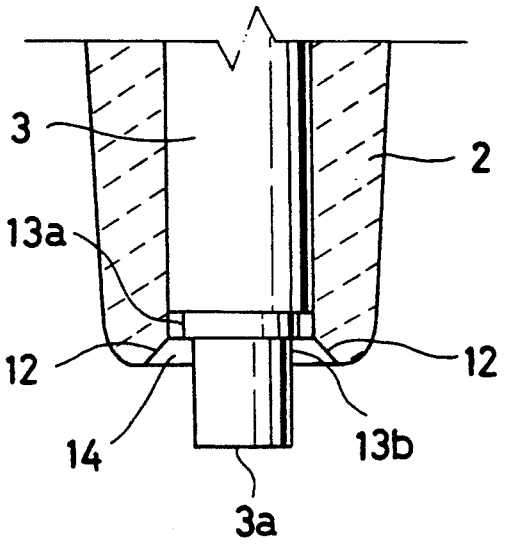
FIG. 2 is an enlarged sectional view of a main part of the spark plug according to the embodiment of the invention.
Figure 3:
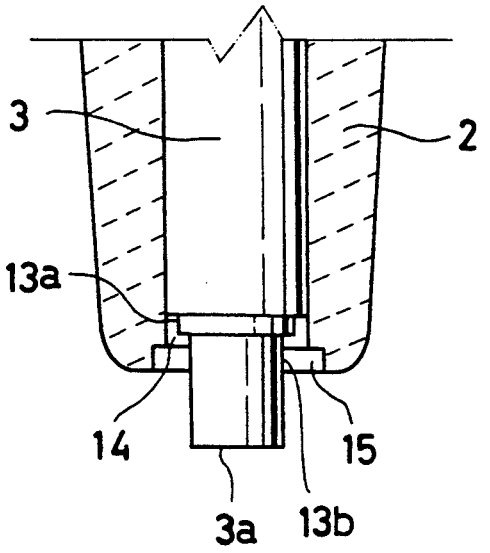
FIG. 3 is a view similar to FIG. 2 according to a modified form of the embodiment of the invention.

With the front portion of the center electrode 3, a first stepped portion 13*a* and a second stepped portion 13*b* are provided as a plurality of stepped portions to form a clearance 14 between an outer wall of the center electrode 3 and an inner wall of the insulator 2 as shown in FIG. 2. In this instance, those stepped portions 13*a*, 13*b* are arranged to progressively decrease their diameter toward the front end of the center electrode 3. With a front open end 11 of the insulator 2, a tapered portion 12 is provided at an inner wall of the insulator 2 by bevelling the front open end 11 of the insulator 2. It is noted that a diameter-increased annular recess 15 may be provided instead of the tapered portion 12 as shown in FIG. 3.

Figure 4:
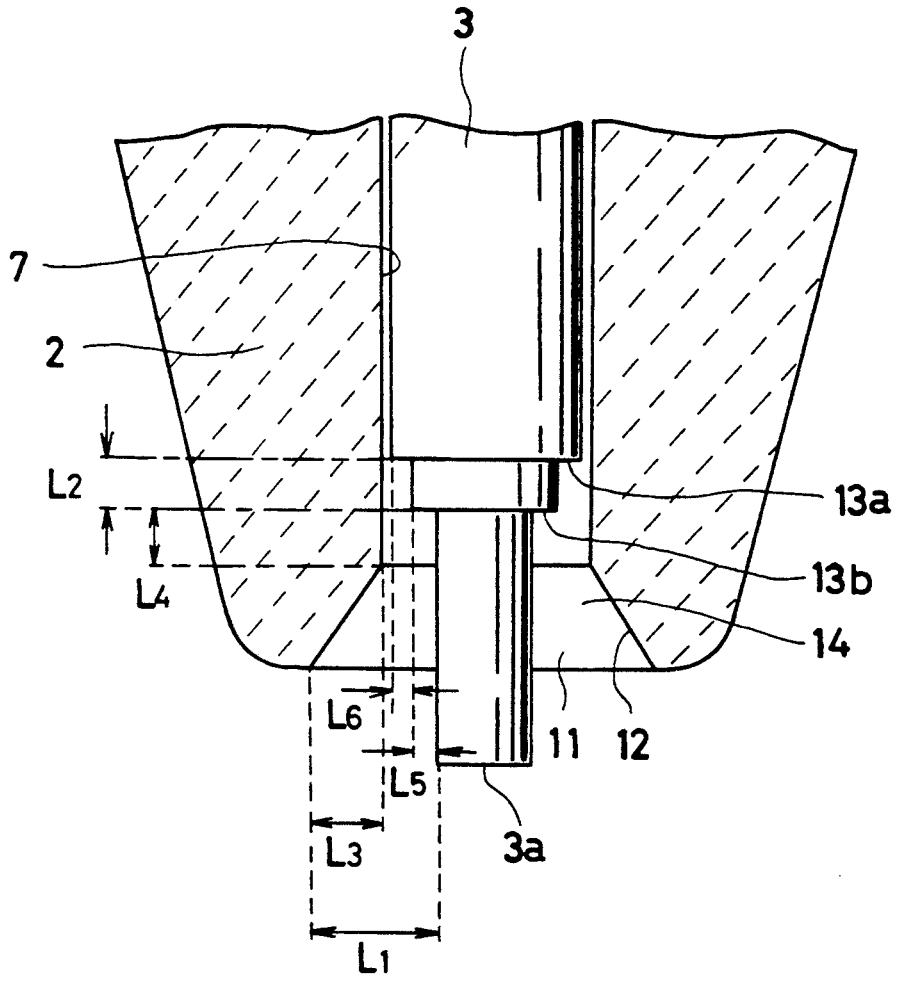
FIG. 4 is a more enlarged sectional view of a main part of the spark plug to show the dimensional relationship among L1, L2, L3, L4, L5 and L6.

As shown in FIG. 4, the dimensional relationship among L1, L2, L3, L4, L5 and L6 are determined as follows:

$L1 \geqq 0.1$ mm, $1.0$ mm $\geqq L2 \geqq 0.3$ mm, $L3 \geqq 0.2$ mm, $L4 \geqq 0.3$ mm, $L5 \geqq 0.1$ mm, $L6 \geqq 0.1$ mm, where L1 = a distance between an outermost periphery of the tapered portion 12 and an outer surface of the second stepped portion 13*b*;

L2 = a length of the first stepped portion 13*b*;

L3 = a lateral difference between the outermost periphery and an innermost periphery of the tapered portion 12;

L4 = a longitudinal distance between an outer surface of the first stepped portion 13*a* and the innermost periphery of the tapered portion 12;

L5 = a radius difference between the first stepped portion 13*a* and the second stepped portion 13*b*; and L6 = a radius difference between the first stepped portion 13*a* and the center electrode 3.

With the structure thus described, since the relationship $L1 \geqq 0.4$ mm is determined, the tapered portion 12 enables to introduce flares of combustion swirl into the clearance 14 to remove droplets of liquid fuel retained between the insulator 2 and the center electrode 3, thus preventing an insulation resistance therebetween from unfavorably decreasing. Otherwise, the droplets of liquid fuel absorb particulate carbon to reduce the insulation resistance.

Concerning to the first and second stepped portions 13*a*, 13*b*, the particularly determined relationship $L4 \geqq 0.3$ mm makes it possible to establish flares of spark along the tapered portion 12 between the front end of the metallic shell 8 and the second stepped portion 13*b* when a certain amount of carbon deposit is placed on the front end of the insulator 2. This enables burning removal of dry carbon deposit between the insulator 2 and the center electrode 3 so as to facilitate self-cleaning action to positively maintain an initial insulation resistance of the insulator 2.

With the length of the first stepped portion 13*a* determined to fall within the dimensional range $1.0$ mm $\geqq L2 \geqq 0.3$ mm, this demensional determination enables to effectively dissipate the heat accumulated at the front end of the center electrode 3 directly or through the insulator 2, thus improving the heat-dissipating effect compared to the counterpart in which only the second stepped portion is provided with the center electrode.

In order to prove how the subject invention is improved compared to the counterpart device in which only the second stepped portion is provided with the center electrode, and no tapered portion is provided with the open front end of the insulator, a fouling experiment is carried out with L1 = 0.9 mm, L2 = 0.5 mm, L3 = 0.5 mm, L4 = 0.1 mm, L5 = 0.3 mm and L6 = 0.1 mm determined respectively.

In order to carry out fouling experiment due to the particulate carbon, the spark plug 1 is mounted on 78.5 cc, two-stroke engine. With the ambient temperature 0° C. and choke $\frac{3}{4}$ closed, the operation of the engine is alternately repeated by idling at 1800 rpm for 10 sec. and racing at 1800~4500 rpm for 10 sec. with these idling and racing as a single cycle. The relationship between the number of cycles and the insulation resistance is as shown in Table 1 which indicates how the insulation resistance is maintained compared to the counterpart device.

In order to carry out fouling experiment due to the dry carbon deposit, the spark plug 1 is mounted on 256 cc, four-stroke engine. With the normal temperature and choke $\frac{3}{4}$ closed, the operation of the engine is alternately repeated by idling at 1750 rpm for 3 min. and cessation for 1 min. with these idling and cessation as a single cycle. The relationship between the number of cycles and the insulation resistance is as shown in Table 2 which indicates how much degree the insulation resistance is maintained compared to the counterpart device.

As shown in Table 1 which depicts a relationship between the insulation resistance (MΩ) and the number of cycles by dotting circles (○) and criss-crosses (×) according to the spark plug 1 of the subject invention and the counterpart device in turn, the result shows that the tapered portion 12 enables to remove the particulate carbon to protect the insulation resistance against deterioration, as opposed to the counterpart device in which the insulation resistance gradually deteriorates to cause starting failure at 10 cycles.

Table 2, which depicts the same relationship as Table 1, shows that although the insulation resistance gradually deteriorates until completing 6 cycles, thereafter the dimensional arrangement $L4 \geqq 0.3$ mm makes it possible to establish flares of spark along the tapered surface 12 between the front end of the metallic shell 8 and the first and second stepped portions 13*a*, 13*b*, and thus burningly removing the dry carbon deposit to recover the insulation resistance so as to avoid misfire. This shows how anti-fouling effect is improved as compared to the counterpart device in which the insulation resistance gradually deteriorates to occur starting failure at 7 cycles.

TABLE 1

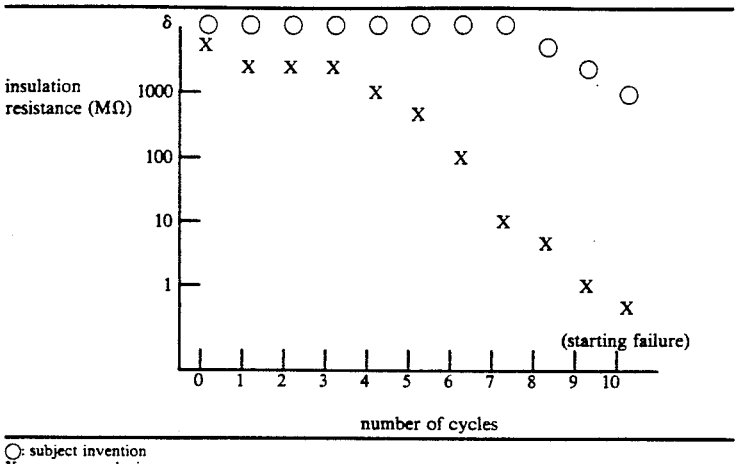

○: subject invention
X: counterpart device

TABLE 2

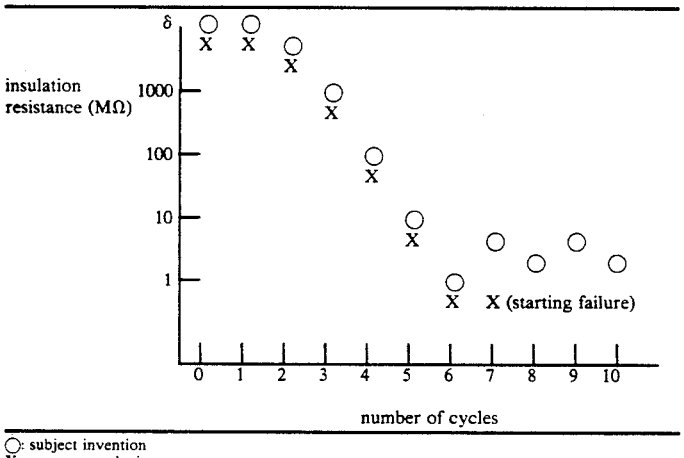

○: subject invention
X: counterpart device

As understood from the foregoing description, the tapered portion is provided with the open front end of the insulator, and at the same time, the stepped portions are provided with the front portion of the center electrode.

The tapered portion removes droplets of liquid fuel retained between the center electrode and the insulator, and thus prevents particulate carbon from being caught between the center electrode and the insulator so as to sufficiently resist decrease of an insulation resistance.

The stepped portions enable to burningly remove the dry carbon deposit between the center electrode and the insulator to protect the spark plug against misfire, thus avoiding starting failure at the time of igniting the internal combustion engine and contributing to saving an amount of fuel consumption.

It is noted that the first and second stepped portions may be respectively bevelled.

Further, it is also appreciated that the diameter of the front portion of the center electrode may be decreased in a three or four-stepped manner instead of a two-stepped manner.

Moreover, it is appreciated that the stepped portions are discretely made so that the stepped portions may be fixedly soldered or brazed to a front end of the center electrode.

While the invention has been described with reference to the specific embodiments, it is understood that this description is not to be construed in a limiting sense inasmuch as various modifications and additions to the specific embodiments may be made by a skilled artisan without departing from the spirit and scope of the invention.

What is claimed is:

1. In a spark plug which includes a metallic shell within which a tubular insulator is placed, and having a center electrode provided within the insulator to form a spark gap between a front end of the center electrode and an outer electrode extended from the metallic shell:

a plurality of stepped portions provided near a front portion of the center electrode to form a clearance between an outer wall of the center electrode and an inner wall of the insulator, the stepped portions being arranged to progressively decrease their diameter toward the front end of the center electrode; and a tapered portion provided at an inner wall of the insulator by bevelling a front open end of the insulator;

said stepped portions comprising a first stepped portion and a second stepped portion of progressively decreasing diameter toward the front end of the center electrode, the dimensional relationship among L1, L2, L3, L4 and L6 being as follows:

$L1 \geqq 0.1$ mm, $1.0$ mm $\geqq L2 \geqq 0.3$ mm, $L3 \geqq 0.2$ mm, $L4 \geqq 0.3$ mm, $L5 \geqq 0.1$ mm, $L6 \geqq 0.1$ mm, where L1 = a distance between an outermost periphery of the tapered portion and an outer surface of the second stepped portion;

L2 = a length of the first stepped portion;

L3 = a lateral difference between the outermost periphery and an innermost periphery of the tapered portion;

L4 = a longitudinal distance between an outer surface of the first stepped portion and the innermost periphery of the tapered portion;

L5 = a radius difference between the first stepped portion and the second stepped portion; and L6 = a radius difference between the first stepped portion and the center electrode.

* * * * *